US005749514A

United States Patent [19]

Brown et al.

[11] Patent Number: 5,749,514

[45] Date of Patent: May 12, 1998

[54] HOLLOW STACKABLE PRODUCT WITH CURVED SIDESTRIPS IN LONGITUDINAL FOLDS OF CONICALLY CONTOURED SIDEWALLS

[75] Inventors: Paul Philip Brown, Carlsbad, Calif.; Jens Ole Sorensen, Cayman Kai, Cayman Islands

[73] Assignee: Universal Ventures, Cayman Islands

[21] Appl. No.: 650,167

[22] Filed: May 20, 1996

[51] Int. Cl.[6] ..... B65D 3/06

[52] U.S. Cl. ..... 229/400; 229/45

[58] Field of Search ..... 229/400, 45; 220/671

[56] References Cited

U.S. PATENT DOCUMENTS

| | | | |
|---|---|---|---|
| 991,246 | 5/1911 | Rosenfeld | 229/400 |
| 1,310,698 | 7/1919 | Hill | 229/400 |
| 1,864,836 | 6/1932 | Lacner | 229/400 |
| 2,041,437 | 5/1936 | Sidon | 229/400 |
| 2,240,045 | 4/1941 | Mackenzie | 229/400 |
| 2,459,073 | 1/1949 | Hamilton | 229/400 |
| 4,284,226 | 8/1981 | Herbst | 229/400 |
| 5,267,685 | 12/1993 | Sorensen . | |

*Primary Examiner*—Christopher T. McDonald
*Attorney, Agent, or Firm*—Edward W. Callan

[57] ABSTRACT

A hollow stackable injection-molded product includes a generally conically contoured sidewall having a plurality of longitudinal folds of alternating ridges and furrows. Each fold includes a first side strip laterally extending from the top of a first ridge to the bottom of a first furrow and a second side strip laterally extending from the bottom of the first furrow to the top of a second ridge next to the first ridge. Over most of the longitudinal extent of the sidewall, at least a predominant portion of each of the second side strips has an outward approximately conic-section lateral curvature to thereby provide a better fit between like products of such configuration when stacked inside one another and to thereby further reduce their stacking height. The lateral curvature of each second side strip is approximately circular. The lateral curvature of the individual second side strips is defined by a radius, with the length of the radius varying in accordance with only the longitudinal extent of the sidewall. The radii for the individual second side strips respectively extend from different points of origin on an approximately circular arc.

22 Claims, 1 Drawing Sheet

HOLLOW STACKABLE PRODUCT WITH CURVED SIDESTRIPS IN LONGITUDINAL FOLDS OF CONICALLY CONTOURED SIDEWALLS

BACKGROUND OF THE INVENTION

The present invention generally pertains to hollow stackable products and is particularly directed to an improvement in the stackability of hollow products of the type that include a section of a generally conically contoured sidewall having a plurality of longitudinal folds of alternating ridges and furrows. The longitudinal folds enhance the stiffness of such hollow stackable products.

A prior art product of this type is shown in U.S. Pat. No. 5,267,685 to Jens Ole Sorensen, one of the inventors of the present invention. The hollow stackable product described therein comprises at least a section of a generally conically contoured sidewall having a plurality of longitudinal folds of alternating ridges and furrows, each fold including a first side strip laterally extending from the top of a first said ridge to the bottom of a first said furrow; and a second side strip laterally extending from the bottom of the first said furrow to the top of a second said ridge next to the first said ridge, wherein the first side strip has a greater wall thickness than the second side strip. Products of such configuration can be stacked within one another without there being much space between the side strips of adjacent stacked products, whereby the stacking height of such products was reduced in relation to the stacking height of earlier prior art products of this type.

SUMMARY OF THE INVENTION

In one aspect, the present invention provides a hollow stackable injection-molded product comprising at least a section of a generally conically contoured sidewall having a plurality of longitudinal folds of alternating ridges and furrows, each fold including a first side strip laterally extending from the top of a first said ridge to the bottom of a first said furrow; and a second side strip laterally extending from the bottom of the first said furrow to the top of a second said ridge next to the first said ridge; wherein the first side strips have a greater wall thickness than the second side strips; and wherein over at least most of the longitudinal extent of the section of the sidewall, at least a predominant portion of each of a plurality of the second side strips has an outward lateral curvature. The present invention thereby provides a better fit between hollow stackable products of such configuration to thereby further reduce the stacking height.

In another aspect, the present invention provides a hollow stackable product comprising at least a section of a generally conically contoured sidewall having a plurality of longitudinal folds of alternating ridges and furrows, each fold including a first side strip laterally extending from the top of a first said ridge to the bottom of a first said furrow; and a second side strip laterally extending from the bottom of the first said furrow to the top of a second said ridge next to the first said ridge; wherein over at least most of the longitudinal extent of the section of the sidewall, at least a predominant portion of each of a plurality of the second side strips has an outward approximately circular lateral curvature.

The present invention further provides a stack of two like products according to the present invention.

Additional features of the present invention are described with reference to the detailed description of the preferred embodiment.

DETAILED DESCRIPTION

Figure 1:
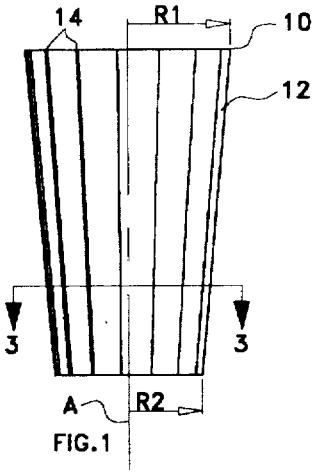
FIG. 1 is a side plan view of a preferred embodiment of a hollow stackable product according to the present invention.
Figure 3:
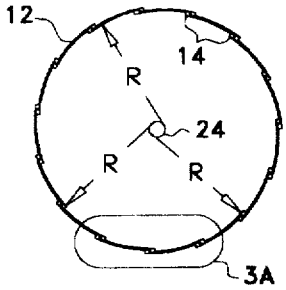
FIG. 3 is an enlarged sectional view of the product shown in FIG. 1 taken along lines 3—3.
Figure 3B:
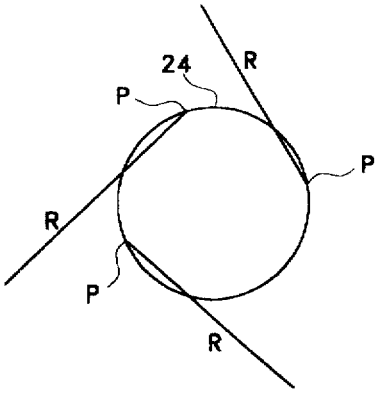
FIG. 3B is an enlargement of the center portion of FIG. 3 illustrating the manner in which three of the radii defining the curvature of the second side strips extend from different points on a circular arc.
Figure 2:
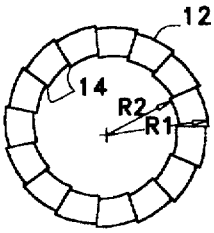
FIG. 2 is a top plan view of the product shown in FIG. 1.
Figure 3A:
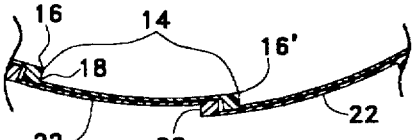
FIG. 3A is a further enlarged sectional view of the portion of the sidewall of the product of FIG. 1 shown in region 3A of FIG. 3.
Figure 4:
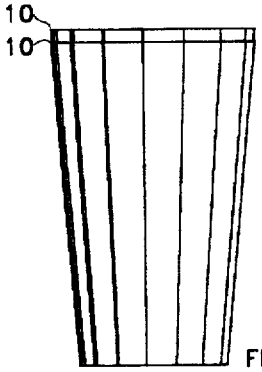
FIG. 4 is side plan view of a stack of hollow stackable products as shown in FIG. 1.

Referring to the Drawing, a preferred embodiment of a hollow stackable product 10 according to the present invention includes a section of a generally conically contoured sidewall 12 having a plurality of longitudinal folds 14 of alternating ridges 16 and furrows 18. Each fold 14 includes a first side strip 20 laterally extending from the top of a first ridge 16 to the bottom of a first furrow 18 and a second side strip 22 laterally extending from the bottom of the first furrow 18 to the top of a second ridge 16' next to the first ridge 16, as best seen in FIG. 3A. Over most of the longitudinal extent of the section of the sidewall 12, at least the predominant portion of each of the second side strips 22 has an outward approximately conic-section lateral curvature. The first side strip 20 has a shorter lateral extent than the second side strip 22. In alternative embodiments (not shown), the first side strip 20 does not have a shorter lateral extent than the second side strip 22. The longitudinal folds 14 are not parallel to the longitudinal axis A of the product 10; and the first side strips 20 need not be in a plane that contains the longitudinal axis A. The first side strips 20 do not have to be straight. For example, the first side strips 20 may tend to have a spiral shape.

Preferably, the first side strips 20 have a greater wall thickness than the second side strips 22. The variation in wall thickness may reduce the required injection pressure and clamp force when the product is manufactured by an injection molding process.

In the preferred embodiment the lateral curvature of each second side strip 22 is approximately circular. The lateral curvature of the individual second side strips 22 is defined by a radius, with the length of the radius R varying in accordance with only the longitudinal extent of the sidewall 12. At a given longitudinal position of the sidewall 12, the radii R for the individual second side strips 22 respectively extend from different points of origin P on a circular arc 24, as best seen in FIG. 3B. In the preferred embodiment shown in the Drawing there are fifteen such points of origin P uniformly spaced at twenty-four degree intervals around the circular arc 24 to thereby define fifteen second side strips 22. In the preferred embodiment the circular arc 24 from which the radii R respectively extend is of an approximately uniform dimension for most of the longitudinal extent of the sidewall 12.

In the preferred embodiment, the ridges 16 and furrows 18 of the folds 14 have a sharp contour as best seen in FIG. 3A. In alternative preferred embodiments (not shown), the ridges and furrows of the folds are rounded, such as shown in FIG.

5 of the aforementioned U.S. Pat. No. 5,267,685, or the folds include combinations of sharp and rounded ridges and furrows and/or ridges and/or furrows having other contours.

When one product 10 is disposed in a like product 10 such that each first side strip 20 of the one product is positioned closely adjacent a first side strip 20 of the other product and each second side strip 22 of the one product is positioned closely adjacent a second side strip 22 of the second product the product 10 has a shorter stacking height than the prior art products.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as exemplifications of the preferred embodiments described herein. Other variations are possible and the scope of the present invention should be determined not by the embodiments described herein but rather by the claims and their legal equivalents.

We claim:

1. A hollow stackable injection-molded product, comprising at least a section of a generally conically contoured sidewall having a plurality of longitudinal folds of alternating ridges and furrows, each fold including a first side strip laterally extending from the top of a first said ridge to the bottom of a first said furrow; and a second side strip laterally extending from the bottom of the first said furrow to the top of a second said ridge next to the first said ridge;

wherein the first side strips have a greater wall thickness than the second side strips; and wherein over at least most of the longitudinal extent of the section of the sidewall, at least a predominant portion of each of a plurality of the second side strips has an outward lateral curvature.

2. A hollow stackable product, comprising at least a section of a generally conically contoured sidewall having a plurality of longitudinal folds of alternating ridges and furrows, each fold including a first side strip laterally extending from the top of a first said ridge to the bottom of a first said furrow; and a second side strip laterally extending from the bottom of the first said furrow to the top of a second said ridge next to the first said ridge;

wherein over at least most of the longitudinal extent of the section of the sidewall, at least a predominant portion of each of a plurality of the second side strips has an outward approximately circular lateral curvature.

3. A product according to claim 1, wherein the first side strip has a shorter lateral extent than the second side strip.

4. A product according to claim 3, wherein the lateral curvature of the individual second side strips is defined by a radius, with the length of the radius varying in accordance with only the longitudinal extent of the sidewall.

5. A product according to claim 4, wherein at a given longitudinal position of the sidewall the radii for the individual second side strips respectively extend from different points on an approximately circular arc.

6. A product according to claim 5, wherein the different points are uniformly spaced around the arc.

7. A product according to claim 5, wherein the arc from which the radii respectively extend is of an approximately uniform dimension for a plurality of longitudinal positions.

8. A product according to claim 2, wherein the lateral curvature of the individual second side strips is defined by a radius, with the length of the radius varying in accordance with only the longitudinal extent of the sidewall.

9. A product according to claim 8, wherein at a given longitudinal position of the sidewall the radii for the individual second side strips respectively extend from different points on an approximately circular arc.

10. A product according to claim 9, wherein the different points are uniformly spaced around the arc.

11. A product according to claim 9, wherein the arc from which the radii respectively extend is of an approximately uniform dimension for a plurality of longitudinal positions.

12. A stack of at least two like products according to claim 1.

13. A stack of at least two like products according to claim 2.

14. A stack of products according to claim 12, wherein the first side strip has a shorter lateral extent than the second side strip.

15. A stack of products according to claim 14, wherein the curvature of the individual second side strips is defined by a radius, with the length of the radius varying in accordance with only the longitudinal extent of the sidewall.

16. A stack of products according to claim 15, wherein at a given longitudinal position of the sidewall the radii for the individual second side strips respectively extend from different points on an approximately circular arc.

17. A stack of products according to claim 16, wherein the different points are uniformly spaced around the arcs.

18. A stack of products according to claim 16, wherein the arc from which the radii respectively extend is of an approximately uniform dimension for a plurality of longitudinal positions.

19. A stack of products according to claim 13 wherein the curvature of the individual second side strips is defined by a radius, with the length of the radius varying in accordance with only the longitudinal extent of the sidewall.

20. A stack of products according to claim 19, wherein at a given longitudinal position of the sidewall the radii for the individual second side strips respectively extend from different points on an approximately circular arc.

21. A stack of products according to claim 20, wherein the different points are uniformly spaced around the arc.

22. A stack of products according to claim 20, wherein the arc from which the radii respectively extend is of an approximately uniform dimension for a plurality of longitudinal positions.

* * * * *